US009837696B2

(12) United States Patent
Chang

(10) Patent No.: US 9,837,696 B2
(45) Date of Patent: Dec. 5, 2017

(54) TRANSMISSION LINE STRUCTURE FOR TRANSMITTING RADIO SIGNALS

(71) Applicant: Wistron NeWeb Corp., Hsinchu (TW)

(72) Inventor: Chih-Lin Chang, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 159 days.

(21) Appl. No.: 14/926,712

(22) Filed: Oct. 29, 2015

(65) Prior Publication Data

US 2016/0276726 A1 Sep. 22, 2016

(30) Foreign Application Priority Data

Mar. 18, 2015 (TW) ..... 104108581 A

(51) Int. Cl.
*H01P 3/08* (2006.01)
*H01P 3/02* (2006.01)
*H01P 5/02* (2006.01)

(52) U.S. Cl.
CPC ..... *H01P 3/026* (2013.01); *H01P 5/028* (2013.01)

(58) Field of Classification Search
CPC ..... H01P 3/026; H01P 5/028
USPC ..... 333/246
See application file for complete search history.

(56) References Cited

U.S. PATENT DOCUMENTS

2014/0306776 A1* 10/2014 Eom ..... H01P 3/003 333/1

* cited by examiner

*Primary Examiner* — Stephen E Jones
*Assistant Examiner* — Scott S Outten
(74) *Attorney, Agent, or Firm* — Muncy, Geissler, Olds & Lowe, P.C.

(57) ABSTRACT

A transmission line structure for transmitting radio signals includes a first transmission line, a first ground region, and a second transmission line. The first transmission line is arranged on a first layer of a circuit board. The first transmission line includes a first signal line and a second signal line. The first ground region is arranged between the first and second signal lines. The first and second signal lines do not contact the first ground region. The second transmission line is arranged on a second layer of the circuit board, and the second layer is different from the first layer. The second transmission line does not contact the first transmission line, and the second transmission line interleaves with the first signal line, the second signal line and the first ground area.

19 Claims, 3 Drawing Sheets

TRANSMISSION LINE STRUCTURE FOR TRANSMITTING RADIO SIGNALS

CROSS REFERENCE TO RELATED APPLICATIONS

This Application claims priority of Taiwan Patent Application No. 104108581 filed on Mar. 18, 2015, the entirety of which is incorporated by reference herein.

BACKGROUND OF THE INVENTION

Field of the Invention

The disclosure generally relates to a transmission line structure, and especially to a transmission line structure for transmitting radio signals.

Description of the Related Art

In order to achieve better area utilization, it is often necessary to cross and interleave various kinds of signal lines. For example, the signal lines could be utilized to transmit many radio signals of a radio frequency, intermediate frequency, and direct current. In order to avoid a short-circuit, which can be caused by interleaving various kinds of signal lines, bond-wiring and back-board wiring are utilized to cross and interleave with the signal lines. However, utilizing the bond-wiring increases costs, and may result in high-frequency effects such as parasitism and coupling, affecting the efficiency of the circuit. In addition, although utilizing the back-board wiring does not increase the cost, the back-board wiring results in high-frequency effects, detracting from the circuit's performance. For example, when grooving the slot and arranging signal lines, the slot will damage the continuity of the ground layer. In addition, wiring between different signal lines will also cause interference for radio signals. Therefore, a transmission line structure is needed to reduce the high-frequency effects without sacrificing circuit performance and increasing the cost.

BRIEF SUMMARY OF THE INVENTION

In order to solve the aforementioned problem, the invention proposes a transmission line structure for transmitting signals which can reduce high-frequency effects and avoid affecting circuit performance. The transmission line structure of the present invention is a multi-line structure which combines the single-line structure and the coplanar waveguide. The transmission line structure can convert the up-and-down electrical field of the transmission line into the left-and-right electrical field, and reduce interference with other transmission lines. In addition, by adjusting the line width and spacing of transmission lines, the resistance-matching could be improved and the radiation effect could be reduced to avoid deteriorating the circuit performance.

In one aspect of the invention, a transmission line structure for transmitting radio signals is provided. The transmission line structure includes a first transmission line, a first ground region and a second transmission line. The first transmission line is arranged on a first layer of a circuit board. The first transmission line includes a first signal line and a second signal line. The first terminal of the first signal line connects to the first terminal of the second signal line, and the second terminal of the first signal line relative to the first terminal connects to the second terminal of the second signal line relative to the first terminal. The first ground region is arranged between the first and second signal lines. The first and second signal lines do not contact the first ground region. The second transmission line is arranged on a second layer of the circuit board, and the second layer is different from the first layer. The second transmission line does not contact the first transmission line, and the second transmission line interlaces with the first and second signal lines and the first ground layer.

In another aspect of the invention, the first signal line and the first ground area are spaced by a first spacing, and the second signal line and the first ground are spaced by the first spacing. The value of the resistance of the first transmission line is related to the first spacing and line widths of the first signal line and the second signal line. In addition, the transmission line structure further includes a second ground area and a third ground area arranged on the first layer, and the first signal line is arranged between the first ground layer and the second ground layer, the second signal line is arranged between the first ground layer and the third ground layer, the first signal line and the second ground area are spaced by a second spacing, and the second signal line and the third ground area are spaced by a third spacing. The first spacing is equal to the second spacing and the third spacing. The resistance value of the first transmission line is related to the first spacing, the second spacing, the third spacing, and line widths of the first signal line and the second signal line.

In another embodiment, the width of the first ground area is larger than or equal to three times the line widths of the first signal line and the second signal line. The width of a portion of the second ground area which is adjacent to the first signal line is larger than or equal to three times the line width of the first signal line, and the width of a portion of the third ground area which is adjacent to the second signal line is larger than or equal to three times the line width of the second signal line. The first transmission line is a coplanar waveguide. In addition, the first signal line, the second signal line and the first ground area are vertical to the second transmission line. Lengths of the first signal line, the second signal line, and the first ground area are longer than or equal to the length of the second transmission line.

In another embodiment, the first transmission line further comprises a first single-line area and a second single-line area, the first single-line area connects the first terminal of the first signal line and the first terminal of the second signal line, the second single-line area connects the second terminal of the first signal line and the second terminal of the second signal line, and the second transmission line does not interleave with the first single-line area and the second single-line area. Furthermore, the resistance value of the first single-line area is equal to an equivalent resistance value of the first signal line and the second signal line, and the equivalent resistance value of the first signal line and the second signal line is equal to the resistance value of the second single-line area.

In another aspect of the invention, a transmission line structure for transmitting radio signals is provided. The transmission line structure includes a first transmission line and a second transmission line. The first transmission line is arranged on a first layer of a circuit board. The first transmission line includes at least three signal lines, and the transmission line structure includes at least two ground areas. Each of the at least two ground areas are arranged between every two of the at least three signal lines. The second transmission line is arranged on a second layer of the circuit board, and the second layer is different from the first layer. The second transmission line interleaves with at least three signal lines and at least two ground areas.

BRIEF DESCRIPTION OF DRAWINGS

The invention can be more fully understood by reading the subsequent detailed description and examples with references made to the accompanying drawings, wherein.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF THE INVENTION

In order to illustrate the purposes, features and advantages of the invention, the embodiments and figures of the invention are shown in detail as follows. This description is made for the purpose of illustrating the general principles of the invention and should not be taken in a limiting sense. It should be understood that the embodiments may be realized in software, hardware, firmware, or any combination thereof.

Figure 1A:
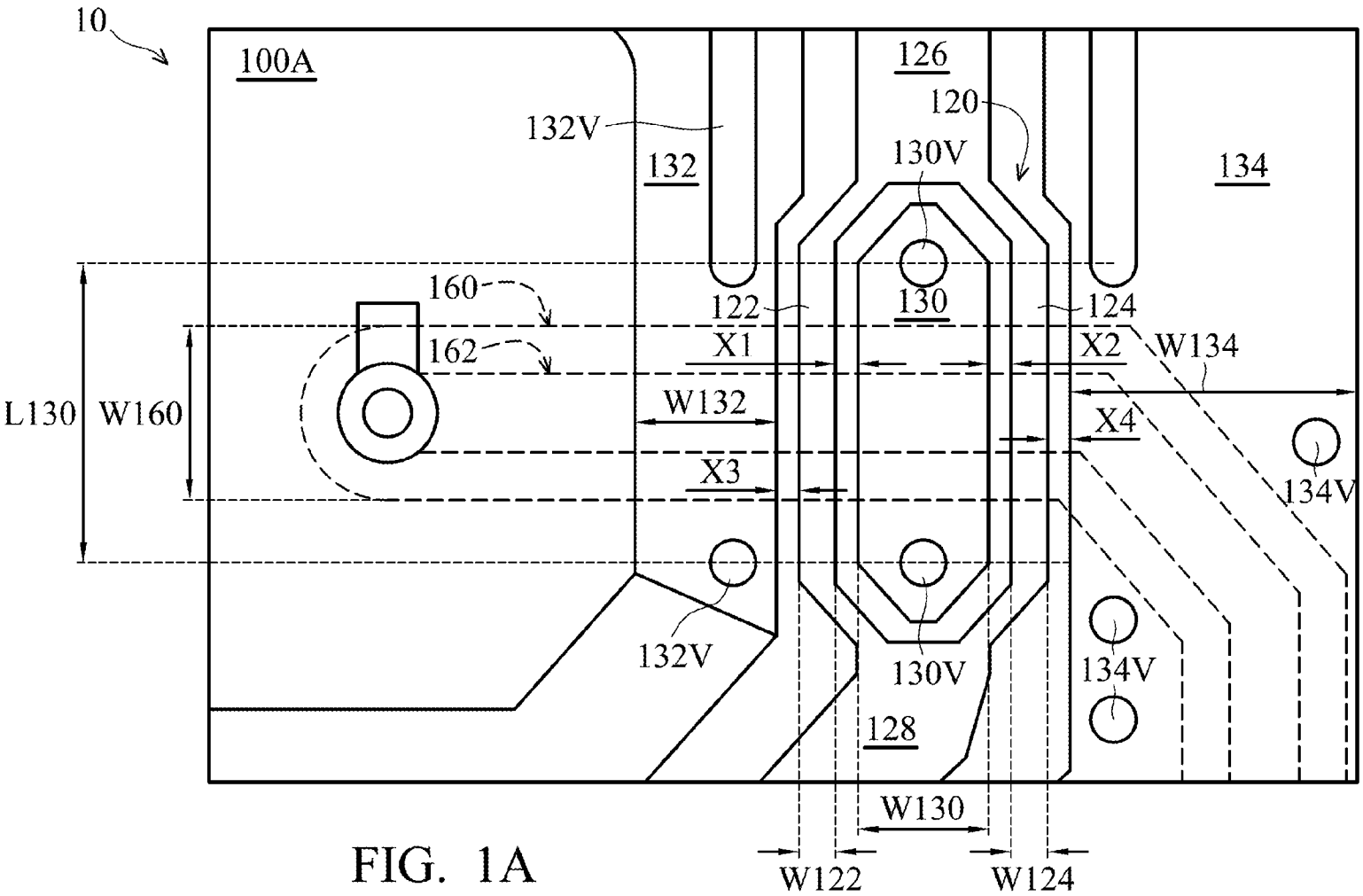
FIG. 1A is a top view of a transmission line structure according to an embodiment of the invention.
Figure 1B:
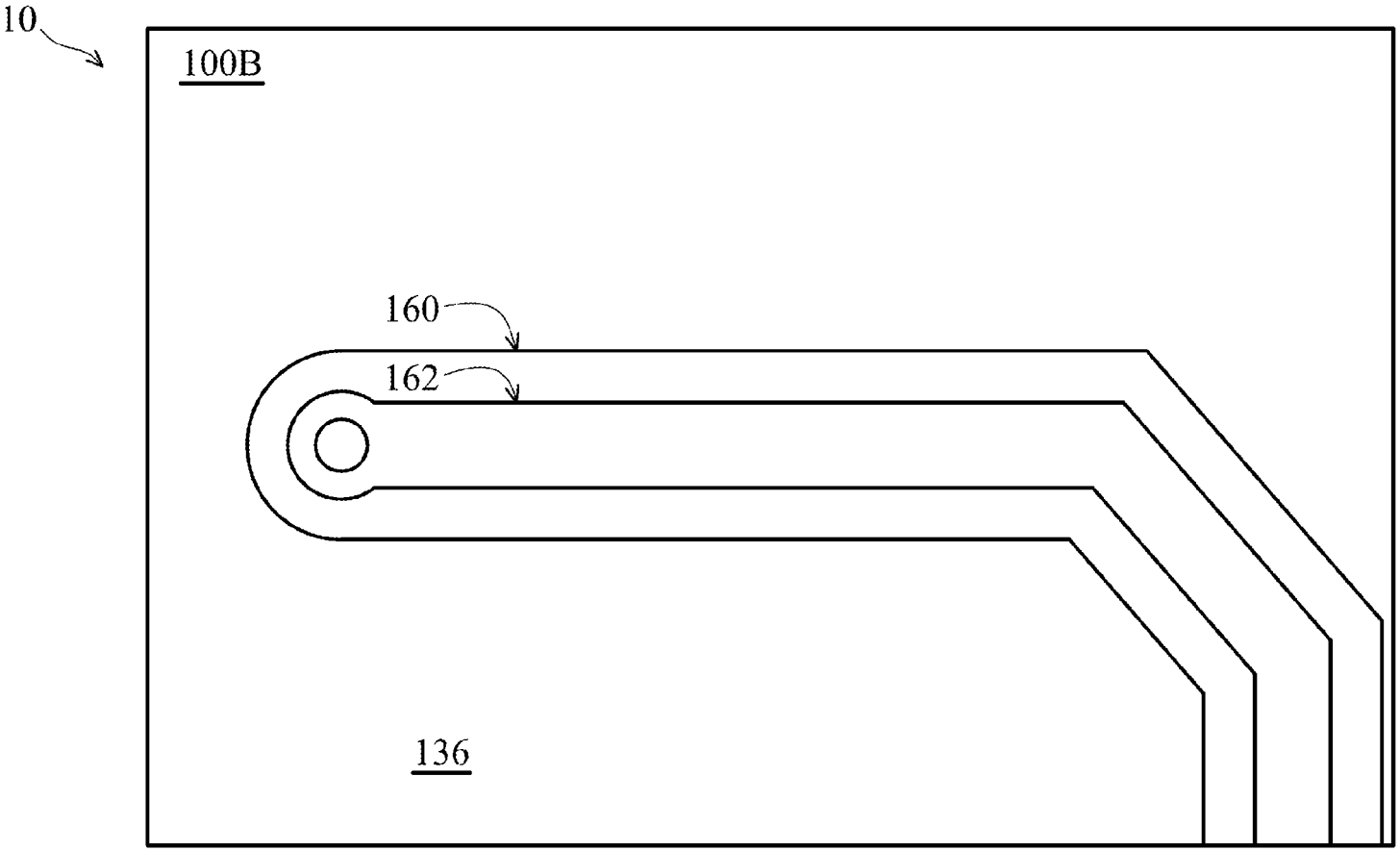
FIG. 1B is a bottom view of a transmission line structure according to an embodiment of the invention.

FIG. 1A is a top view of a transmission line structure 10 according to an embodiment of the invention, and FIG. 1B is a bottom view of a transmission line structure 10 according to an embodiment of the invention. The transmission line structure 10 is utilized to transmit at least one radio signal, such as radio frequency (RF) signal, intermediate frequency (IF) signal and direct current (DC) signal. In one embodiment, the transmission line structure 10 includes a first transmission line 120, a ground area 130 (the first ground area) and a second transmission line 162. The first transmission line 120 and the second transmission line 162 are utilized to transmit different radio signals respectively. For example, the first transmission line 120 transmits the radio signal, and the second transmission line 162 transmits the DC signal. As shown in FIG. 1A, the first transmission line 120 and the ground area 130 are arranged on the first layer 100A of a circuit board. As shown in FIG. 1B, the second transmission line 162 is arranged on the second layer 100B of the circuit board. Specifically, the slot 160 and the ground area 136 are included in the second layer 100B of the circuit board, and the second transmission line 162 is arranged within the slot 160. The second layer 100B is different from the first layer 100A, and the first transmission line 120 does not touch the second transmission line 162 to avoid causing a short-circuit. For example, the circuit board is a printed circuit board (PCB), and the first layer 100A and the second layer 100B are on the front and the back of the circuit board. In another embodiment, the first layer 100A and the second layer 100B are both arranged on the front board or the back board of the circuit board, but they are manufactured by different manufacturing conditions or processes. The present invention does not limit it thereto.

In the embodiment of FIG. 1A, the first transmission line 120 includes the signal line 122 (the first signal line) and the signal 124 (second signal line). The ground area 130 (first ground area) is arranged between the signal lines 122 and 124, and the signal lines 122 and 124 do not contact the ground area 130 to avoid causing a short-circuit. The ground area 130 could include at least one via hole 130V for electrically connecting the ground area of the second layer 100B. In addition, the second transmission line 162 is interleaved with the signal lines 122 and 124 and the ground area 130. For example, the signal lines 122 and 124 and the ground area 130 are vertical to the second transmission line 162 to arrange the wiring on the circuit board efficiently and improve the area-usage of the circuit board. It should be noted that there is a spacing X1 between the signal line 122 and the ground area 130, and there is a spacing X2 between the signal line 124 and the ground area 130. For example, the spacing X1 is equivalent to the spacing X2 (i.e., the first spacing). In addition, signal lines 122 and 124 have line widths W122 and W124 respectively. The resistance value of the first transmission line 120 is related to the first spacing and line widths W122 and W124 of transmission lines 122 and 124. For example, when the value of the line widths W122 and W124 is fixed, the resistance value of the first transmission line 120 increases as the first spacing increases. When the value of the first spacing is fixed, the resistance value of the first transmission line 120 decreases as the value of the line width W122 and W124 increases.

Specifically, the first transmission line 120 including the signal lines 122, 124 and the ground area 130 is a coplanar waveguide to guide and convert the up-and-down directional electrical field of the first transmission line 120 into a left-and-right directional planar electrical field. Compared with other well-known transmission lines, less of an up-and-down directional electrical field is generated by the first transmission line 120 of the coplanar waveguide. Therefore, the interference caused by the wiring and grooving of other transmission lines (such as the second transmission line 162) could be reduced. When the electrical field of the radio signal passes through the wiring and grooving of other transmission lines, the effect of the non-continuous electrical field could be greatly decreased.

In one embodiment, the first transmission line 120 further includes the single-line area 126 (first single-line area) and the single-line area 128 (second single-line area). The single-line area 126 connects the first terminal of the transmission lines 122 and 124, and the single-line area 128 connects the second terminal of the transmission lines 122 and 124. The second terminal is relative to the first terminal, and the second transmission line 162 does not interleave with the single-line areas 126 and 128. It should be noted that the length L130 of the signal lines 122, 124 and the ground area 130 is larger than or equal to the width W160 of the slot 160. As such, the first transmission line 120 includes the single-line areas 126 and 128 and the double-line area composed by the signal lines 122 and 124. The second transmission line 162 crosses and passes through the double-line area composed by the signal lines 122, 124 and the ground area 130 to reduce the signal-radiating effect. The length L130 of the double-line area is larger than or equal to the width W160 of the slot 160. In another embodiment, the length L130 of the double-line area could be defined as the distance between the two via holes 130V of the ground area 130, but the invention is not limited thereto.

The first transmission line 120 includes the single-line regions 126, 128 and the double-line region which is composed of the signal lines 122, 124 and the ground area 130. In order to match resistance to reduce the loss for transmitting signals, the spacing X1, X2 and the line widths W122, W124 could be adjusted to obtain ideal resistance values for the signal lines 122 and 124. In one embodiment, the resistance value of the single-line 126 is equal to the equivalent resistance value of the signal lines 122 and 124, and the equivalent resistance value of the signal lines 122 and 124 are equal to the resistance value of the single-line area 128. For example, the resistance value of the single-line areas 126 and 128 are 50 ohm, and the resistance value of the signal lines 122 and 124 are 100 ohm. The equivalent resistance value of connecting the two signal lines 124 and 124 in parallel is also 50 ohm, which is equal to the resistance value of the single-line areas 126 and 128. Therefore, when the first transmission line 126 transmits radio signals, the loss for transmitting radio signals could be reduced due to the match of resistance. For example, when utilizing the transmission line structure 10 of the present invention in the frequency band of 20.6 GHz, the insertion loss of the signal is about −0.6 dB. The insertion loss of signals for those utilizing traditional back-board wiring is about −1.9 dB. Therefore, because the resistance of the first transmission line 126 is matched to provide less insertion loss, the accuracy and reliability of transmitting signals could be improved.

In the embodiment as shown in FIG. 1A, the transmission line structure 10 further includes the ground areas 132 (the second ground area) and 134 (third ground area) which are arranged on the first layer 100A. The ground areas 132 and 134 respectively have at least one via hole 132V and 134V each for electrically connecting the ground area 136 on the second layer 100B. The signal line 122 is arranged between the two ground areas 130 and 132, and the signal line 124 is arranged between the two ground areas 130 and 134. There is a spacing X3 (second spacing) between the signal line 122 and the ground area 132 and a spacing X4 (third spacing) between the signal line 124 and the ground area 134. For example, the values of the spacing X1, X2, X3 and X4 are the same. In other words, the first spacing is equal to the second spacing and the third spacing. In another embodiment, the values of the spacing X3 and X4 are different. The second spacing is different from the third spacing. In addition, the resistance value of the first transmission line 120 is related to the spacing X1, X2, X3 and X4, and is related to the line widths W122 and W124 of the signal lines 122 and 124. For example, when the values of the line widths W122 and W124 are fixed, the resistance values of the signal lines 122 and 124 become larger corresponding to the increasing value of the spacing X1, X2, X3 and X4. When the value of the spacing X1, X2, X3 and X4 is fixed, the resistance value of the signal lines 122 and 124 becomes smaller corresponding to the increasing value of the line widths W122 and W124. The spacing X1, X2, X3 and X4 and the line widths W122, W124 could be adjusted to obtain ideal resistance value of the signal lines 122 and 124.

It should be noted that in one embodiment, the width W310 of the ground area 310 is larger than or equal to three times the line widths W122 and W124 of the signal lines 122 and 124. The width W132 of the region where the ground area 132 is adjacent to the signal line 122 is larger than or equal to three times the line width W122 of the signal line 122. The width W134 of the region where the ground area 134 is adjacent to the signal line 124 is larger than or equal to three times the line width W124 of the signal line 124. In other words, the present invention does not limit the width of the portion of the ground area 132 which is not adjacent to the signal line 122, and does not limit the width of the portion of the ground area 134 which is not adjacent to the signal line 124. The above portions of the ground areas 132 and 134 which are not adjacent to the signal lines 122 and 124 could be any shape or size according to the circuit design. It should be noted that regarding the signal line 122 or 124, the widths of the ground areas which are adjacent to the left side and the right side are larger than or equal to three times the line width of the signal line 122 or 124. Therefore, when the signal line 122 or 124 transmits radio signals, its left-and-right directional electrical field could be blocked by the ground area on its left side and right side whose width is more than three times. As such, the up-and-down directional electrical field of the signal line 122 or 124 could be reduced further, and the interference which results from slot or wiring between the first transmission line 120 and the second transmission line 162 could be improved. For example, when utilizing the transmission line structure 10 of the present invention in the radio frequency band of 20.6 GHz, the minimum isolation of the signal is about −20.3 dB. The minimum isolation of signals for those utilizing traditional back-board wiring is about −10.2 dB. Therefore, since the transmission line structure 10 converts the electrical field into horizontal directional electrical field, a better isolation could be provided to isolate the interference caused by other transmission lines which are arranged in up-and-down directions.

Figure 2:
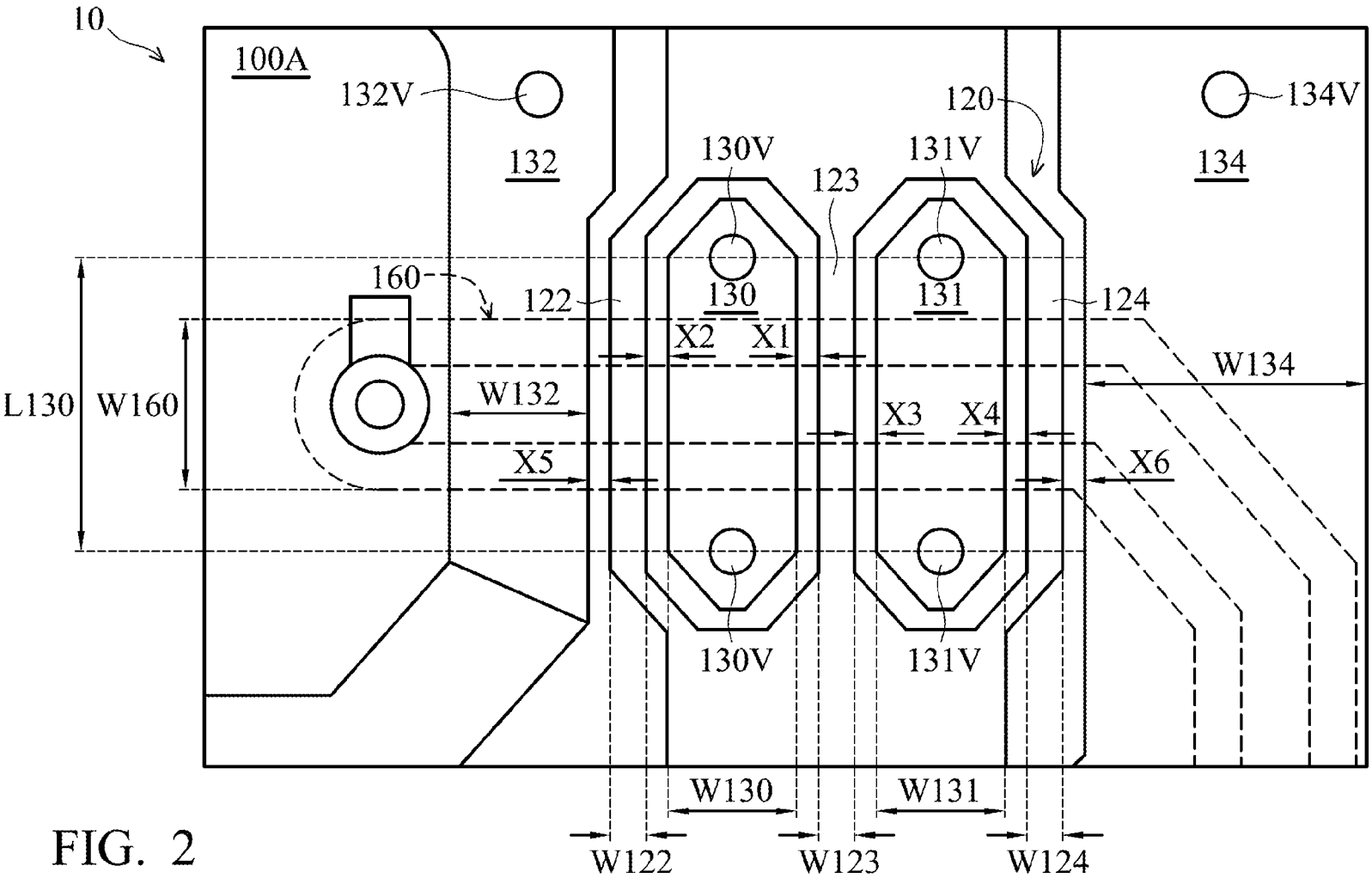
FIG. 2 is another top view of a transmission line structure according to an embodiment of the invention.

FIG. 2 is another top view of a transmission line structure 10 according to an embodiment of the invention. The transmission line structure 10 includes the first transmission line 120 and the second transmission line 162. The first transmission line 120 is arranged on the first layer 100A of a circuit board, and the second transmission line 162 is arranged on the second layer 100B of the circuit board (not shown). The second transmission line 162 does not contact the first transmission line 120 to avoid causing a short-circuit. It should be noted that the first transmission line 120 is a coplanar waveguide. As shown in FIG. 2, the first transmission line 120 includes at least three signal lines 122, 123 and 124, and at least two ground areas 130 and 131. The second transmission line 162 is interleaved with at least three signal lines 122, 123, 124 and at least two ground areas 130 and 131. In one embodiment, each of the ground areas 130 and 131 is arranged between every two adjacent signal lines of the signal lines 122, 123 and 124. For example, the ground area 130 is arranged between the signal lines 122 and 123, and the ground area 131 is arranged between the signal lines 123 and 124. In addition, the width of each of the ground areas 130 and 131 is larger than or equal to three times the line width of each of the signal lines 122, 123 and 124. In other words, the widths W130 and W131 of the ground areas 130 and 131 are larger than or equal to three times the line widths W122, W123 and W124 of the signal lines 122, 123 and 124.

In addition, as shown in FIG. 2, the transmission line structure 10 further includes the ground area (second ground area) and the ground area (third ground area) arranged on the first layer 100A. The ground areas 132 and 134 are arranged on the left side and the right side of the first transmission line 120 respectively. The spacing between the ground area 132, the signal line 122, the ground area 130, the signal line 123, the ground area 131, the signal line 124 and the ground area 134 are X5, X2, X1, X3, X4 and X6. In one embodiment, the width W132 of the portion of the ground area 132 which is adjacent to at least three signal lines 122, 123 and 124 is larger than or equal to three times the line width W122, W123, W124 of the signal lines 122, 123 and 124. The width W134 of the portion of the ground area 134 which is adjacent to at least three signal lines 122, 123 and 124 is larger than or equal to three times the line width W122, W123, W124 of the at least three signal lines 122, 123 and 124. In another embodiment, the first transmission line 120 vertically interleaves with the second transmission line 162, and the length L130 of each of the at least three signal lines 122, 123 and 124 is larger than or equal to the width W160 of the slot 160. The length L130 of each of the at least two ground areas 130 and 131 is larger than or equal to the width W160 of the second transmission line. The length L130 could also be defined as the distance between the two via holes 130V of the ground area 130, and the present invention is not limited thereto.

In the embodiment of FIG. 2, the first transmission line 120 is a coplanar waveguide, and the line widths W122, W123, W124 of the signal lines 122, 123, 124 are less than the width of the ground area which is on its left side and right side. Therefore, the up-and-down directional electrical field of the first transmission line 120 could be converted into a left-and-right directional electrical field. Since the up-and-down directional electrical field of the first transmission line 120 is greatly reduced, the high-frequency coupling effect and interference between the first transmission line 120 and the second transmission line 162 could also be greatly reduced. The amount of signal lines 122, 123, 124 and the ground areas 130, 131, 132 and 134 is for illustration, not for limiting the present invention. Within the scope of the present invention, users can adjust the spacing, line width, and amount of transmission lines and ground areas according to need for the circuit design to achieve resistance-matching and reduce the loss for transmitting signals. Therefore, the accuracy and reliability of transmitting signals can be improved.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements. While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A transmission line structure for transmitting radio signals, comprising:

a first transmission line, arranged on a first layer of a circuit board, wherein the first transmission line comprises a first signal line and a second signal line, a first terminal of the first signal line connects to a first terminal of the second signal line, and a second terminal of the first signal line connects to a second terminal of the second signal line, and the second terminal of the first signal line and the second signal line is relative to the first terminal of the first signal line and the second signal line;

a first ground conductor, arranged on the first layer and between the first signal line and the second signal line, wherein the first signal line and the second signal lines do not contact the first ground area; and a second transmission line, arranged on a second layer of the circuit board, wherein the second layer is different from the first layer, the second transmission line does not contact the first transmission line, and the second transmission line overlaps with the first signal line, the second signal line and the first ground area.

2. The transmission line structure as claimed in claim 1, wherein the first signal line and the first ground conductor are spaced by a first distance, and the second signal line and the first ground are spaced by the first distance.

3. The transmission line structure as claimed in claim 2, wherein the transmission line structure further comprises a second ground conductor and a third ground area arranged on the first layer, and the first signal line is arranged between the first ground layer and the second ground layer, the second signal line is arranged between the first ground layer and the third ground layer, the first signal line and the second ground conductor are spaced by a second distance, and the second signal line and the third ground conductor are spaced by a third distance.

4. The transmission line structure as claimed in claim 3, wherein a width of the first ground conductor is larger than or equal to three times the line widths of the first signal line and the second signal line.

5. The transmission line structure as claimed in claim 4, wherein a width of a portion of the second ground conductor which is adjacent to the first signal line is larger than or equal to three times the line width of the first signal line, and a width of a portion of the third ground conductor which is adjacent to the second signal line is larger than or equal to three times the line width of the second signal line.

6. The transmission line structure as claimed in claim 3, wherein the first distance is equal to the second distance and the third distance.

7. The transmission line structure as claimed in claim 3, wherein the resistance value of the first transmission line is related to the first distance, the second spacing, the third distance, and line widths of the first signal line and the second signal line.

8. The transmission line structure as claimed in claim 2, wherein the resistance value of the first transmission line is related to the first distance and line widths of the first signal line and the second signal line.

9. The transmission line structure as claimed in claim 1, wherein the first transmission line further comprises a third signal line and a fourth ground conductor, the fourth ground conductor is arranged between the second signal line and the third signal line, the second transmission line overlaps with the first signal line, the second signal line, the third signal line, the first ground conductor, and the fourth ground conductor, wherein the first terminal of the third signal line connects to the first terminal of the first signal line and the second signal line, the second terminal of the third signal line connects to the second terminal of the first signal line and the second signal line, and the second terminal is relative to the first terminal.

10. The transmission line structure as claimed in claim 9, wherein the transmission line structure further comprises a second ground conductor and a third ground conductor arranged on the first layer, and the second ground conductor and the third ground conductor are arranged on two sides of the first transmission line.

11. The transmission line structure as claimed in claim 10, wherein a width of a portion of the second ground conductor which is adjacent to the first transmission line is larger than or equal to three times the line width of each of the first signal line, the second signal line and the third signal line, and a width of a portion of the third ground conductor which is adjacent to the first transmission line is larger than or equal to three times the line width of each of the first signal line, the second signal line and the third signal line.

12. The transmission line structure as claimed in claim 9, wherein a width of each of the first ground conductor and the fourth ground area is larger than or equal to three times the line width of each of the first signal line, the second signal line, and the third signal line.

13. The transmission line structure as claimed in claim 9, wherein the first signal line, the second signal line, the third signal line, the first ground conductor and the fourth ground conductor are vertically offset to the second transmission line, and a length of each of the first signal line, the second signal line and the third signal line is larger than or equal to a width of the second transmission line, and a length of each of the first ground conductor and the fourth ground conductor is larger than or equal to a width of the second transmission line.

14. The transmission line structure as claimed in claim 9, wherein the first transmission line further comprises a first single-line area and a second single-line area, the first single-line area connects to the first terminal of the first signal line, the second signal line and the third signal line, the second single-line area connects to the second terminal of the first signal line, the second signal line and the third signal line, and the second transmission line does not overlap with the first single-line area and the second single-line area.

15. The transmission line structure as claimed in claim 1, wherein the first signal line, the second signal line and the first ground conductor are vertically offset from the second transmission line.

16. The transmission line structure as claimed in claim 15, wherein a length of the first signal line, the second signal line and the first ground conductor are larger than or equal to a length of the second transmission line.

17. The transmission line structure as claimed in claim 1, wherein the first transmission line further comprises a first single-line area and a second single-line area, the first single-line area connects to the first terminal of the first signal line and the first terminal of the second signal line, the second single-line area connects to the second terminal of the first signal line and the second terminal of the second signal line, and the second transmission line does not overlap with the first single-line area and the second single-line area.

18. The transmission line structure as claimed in claim 17, wherein the resistance value of the first single-line area is equal to an equivalent resistance value of the first signal line and the second signal line, and the equivalent resistance value of the first signal line and the second signal line is equal to resistance value of the second single-line area.

19. The transmission line structure as claimed in claim 1, wherein the first transmission line is a coplanar waveguide.

* * * * *